US010408410B2

(12) United States Patent
Sanchez et al.

(10) Patent No.: US 10,408,410 B2
(45) Date of Patent: Sep. 10, 2019

(54) LIGHT BEAM PROJECTION DEVICE WITH MECHANICAL ACTUATOR, OPTICAL MODULE AND HEADLAMP PROVIDED WITH SUCH A DEVICE

(71) Applicant: VALEO VISION, Bobigny (FR)

(72) Inventors: Vanesa Sanchez, Bobigny (FR); Marine Courcier, Bobigny (FR); Benoit Reiss, Bobigny (FR); Jean-Paul Ravier, Bobigny (FR); Baptiste Bouissou, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/940,124

(22) Filed: Mar. 29, 2018

(65) Prior Publication Data

US 2018/0283641 A1 Oct. 4, 2018

(30) Foreign Application Priority Data

Mar. 31, 2017 (FR) ..... 17 52808

(51) Int. Cl.
*F21S 41/657* (2018.01)
*F21S 41/25* (2018.01)
(Continued)

(52) U.S. Cl.
CPC ..... *F21S 41/657* (2018.01); *F21S 41/141* (2018.01); *F21S 41/25* (2018.01); *F21S 41/635* (2018.01);
(Continued)

(58) Field of Classification Search
None
See application file for complete search history.

(56) References Cited

U.S. PATENT DOCUMENTS

2009/0046474 A1 2/2009 Sato et al.
2014/0029282 A1* 1/2014 Ravier ..... F21S 41/14 362/510
(Continued)

FOREIGN PATENT DOCUMENTS

EP 2 666 671 A1 11/2013
EP 2 990 264 A2 3/2016
(Continued)

OTHER PUBLICATIONS

French Preliminary Search Report dated Nov. 24, 2017 in French Application 17 52808, filed on Mar. 31, 2017 (with English Translation of Categories of cited documents).

*Primary Examiner* — Elmito Breval
(74) *Attorney, Agent, or Firm* — Oblon, McClelland, Maier & Neustadt, L.L.P.

(57) ABSTRACT

A device for projecting a light beam and having a mechanical actuator, notably for a motor vehicle, including an array of light sources able to emit light rays in order to form the light beam along an optical axis, each light source defining a component of the light beam which has an angle of resolution defined in a plane, the device including moreover a mechanical actuator configured for displacing at least one element of the device in such a way that the optical axis of the light beam is moved between at least two projection directions at a specified frequency of displacement, the projection directions forming between them an angle of displacement substantially coplanar with the angle of resolution, the angle of displacement being equal to a fraction of the angle of resolution of the beam.

20 Claims, 5 Drawing Sheets

Figure 1:
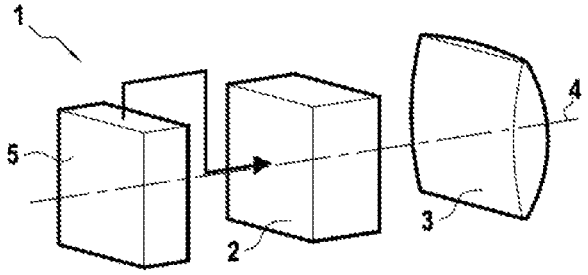

(51) Int. Cl.

| | |
|---|---|
| ***F21S 41/63*** | (2018.01) |
| ***F21S 41/663*** | (2018.01) |
| ***F21S 41/675*** | (2018.01) |
| ***F21S 41/141*** | (2018.01) |
| *F21Y 105/10* | (2016.01) |
| *F21S 41/143* | (2018.01) |

(52) U.S. Cl.
CPC ..... *F21S 41/663* (2018.01); *F21S 41/675* (2018.01); *F21S 41/143* (2018.01); *F21Y 2105/10* (2016.08)

(56) References Cited

U.S. PATENT DOCUMENTS

| | | | | |
|---|---|---|---|---|
| 2016/0265733 | A1* | 9/2016 | Bauer | G02B 3/0006 |
| 2018/0156409 | A1* | 6/2018 | Schwaiger | H01S 5/005 |
| 2018/0320852 | A1* | 11/2018 | Mandl | F21S 41/322 |

FOREIGN PATENT DOCUMENTS

| | | | |
|---|---|---|---|
| JP | 2009-224039 | | 10/2009 |
| WO | WO 2016/093154 | A1 | 6/2016 |
| WO | WO 2016/169772 | A1 | 10/2016 |

* cited by examiner

LIGHT BEAM PROJECTION DEVICE WITH MECHANICAL ACTUATOR, OPTICAL MODULE AND HEADLAMP PROVIDED WITH SUCH A DEVICE

The present invention relates to a device for projecting a light beam and having a mechanical actuator, notably for a motor vehicle, an optical module and a light beam projector of the low beam headlamp or high beam headlamp type, provided with such a projection device.

Motor vehicle headlamps are provided with one or more optical modules arranged in a housing closed by an outer lens in such a way as to obtain one or more light beams at the output of the headlamp. In a simplified way, an optical module of the housing notably comprises a light source, for example one or more light emitting diodes, which emit light rays, and an optical system comprising one or more lenses and, if necessary, an optical element, for example a reflector, for orientating the light beams coming from the light sources in order to form the output light beam of the optical module.

Arrays of light emitting diodes are often used, such a matrices for example, in order to obtain such a beam. Each light emitting diode provides a component of the light beam which emerges from the optical module. Thus, a large number of diodes makes it possible not only to increase the brightness but also to improve the resolution of the lighting obtained. In fact, the beam then comprises more components for a same light beam.

The matrices also make it possible to activate each light emitting diode individually. The individual activation of certain diodes gives the possibility of modulating the shape of the beam, or even to modify its lateral extent when there is potentially a wider beam than the one in use and for which it is only necessary to select a portion of the diodes.

For example, certain technologies make it possible to detect upcoming or followed vehicles upstream of the direction of displacement and to project a light beam with a shadow zone. In other words, the projected beam has light gaps in the direction of the detected vehicle in order to avoid dazzling the driver of the oncoming or followed vehicle, whilst retaining wide illumination on either side of that vehicle. During the use of this function, the light gap or gaps follow the displacement of the detected vehicle; they therefore move within the projected beam. This function requires a high resolution of the beam, notably in order to define the mobile shadow zone with great precision.

Moreover, it is desired to avoid the use of too great a number of light sources simultaneously because this gives rise to high energy consumption and a risk of overheating the optical module.

The purpose of the invention is therefore to obtain a projection device configured for projecting a light beam, which is capable of carrying out functions such as the abovementioned function with high resolution and retaining a small number of diodes.

For this purpose, the invention relates to a device for projecting a light beam and having a mechanical actuator, notably for a motor vehicle, comprising an array of light sources able to emit light rays in order to form the light beam along an optical axis, each light source defining a component of the light beam which has an initial of resolution in a plane.

The device is noteworthy in that it furthermore comprises a mechanical actuator configured for displacing at least one element of the device in such a way that the optical axis of the light beam is moved between at least two projection directions according to a displacement oscillating periodically at a specified frequency of displacement, the projection directions forming between them an angle of displacement substantially coplanar with the angle of resolution, the angle of displacement being equal to a fraction of the initial angle of resolution of the beam.

Thus, by imparting a periodic oscillating displacement of the optical axis of the beam between at least two directions defining an angle of displacement which is a fraction of the initial angle of resolution of the beam, a better final resolution of the light beam is obtained. From then on, for an observer of the light beam, whilst the cut-off edges of the beam are clear, each component will appear as being fractionated.

Consequently, the device makes it possible to increase the resolution of the beam without having to add additional light sources. In particular, the energy consumption and the risks of overheating due to a large concentration of sources are minimized. Moreover, it makes it possible to make use of standard electronic components rather than components that are more complex to produce.

According to different embodiments of the invention, which can be taken together or separately:

- the angle of displacement is substantially equal to half of the angle of resolution,
- the mechanical actuator is configured for moving the element in such a way that the frequency of displacement of the optical axis is a frequency that is not perceptible by the human eye,
- the mechanical actuator is configured for displacing the element in a discontinuous manner in such a way that the optical axis of the light beam is held in each direction of projection for a holding time that is longer than the time of transition between the two directions of projection,
- the light sources can be activated individually at a specified activation frequency in order to modulate the projected beam in such a way as to produce a mobile shadow zone in the light beam,
- the activation frequency of the light sources and the displacement frequency of the optical axis are synchronized,
- the device comprises an optical system configured for forming the light beam from the light rays coming from the light sources,
- the array of light sources is a matrix of light emitting diodes,
- the device comprises projection lens forming means, the projection lens forming means being able to partly form the light beam,
- the mechanical actuator is able to move the array of light sources in translation,
- the mechanical actuator is able to move the array of light sources in rotation,
- the mechanical actuator is able to move the projection lens forming means and the array of light sources jointly in rotation,
- the mechanical actuator is able to move the projection lens forming means in translation,
- the device comprises a mirror configured for reflecting the light beam, the mechanical actuator being able to move the mirror.

The invention also relates to an optical module comprising such a device for projecting a light beam and having a mechanical actuator.

The invention also relates to a motor vehicle headlamp provided with such an optical module.

Figure 2:
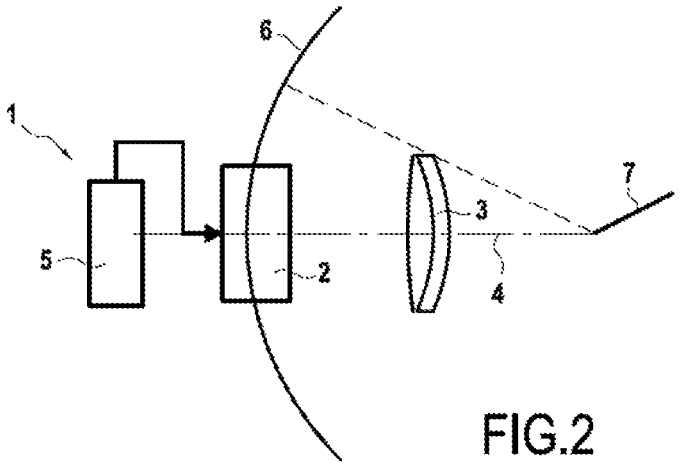
Figure 3:
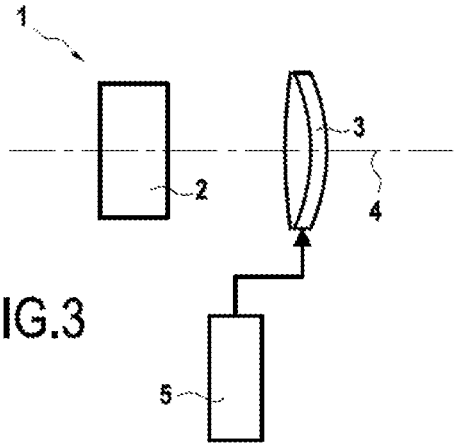
Figure 4:
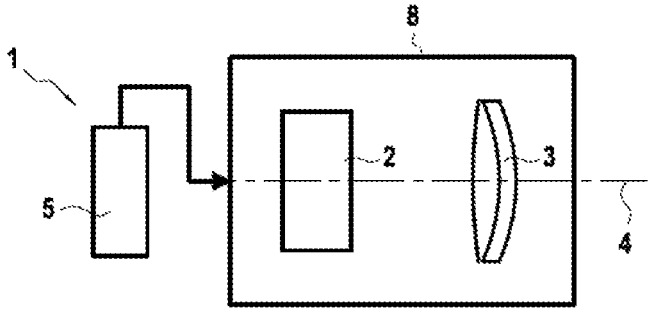
Figure 5:
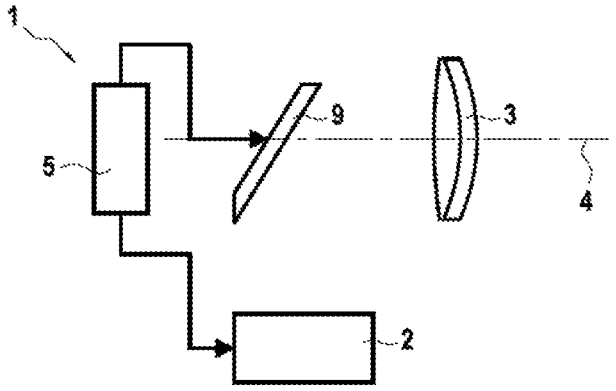
Figure 6:
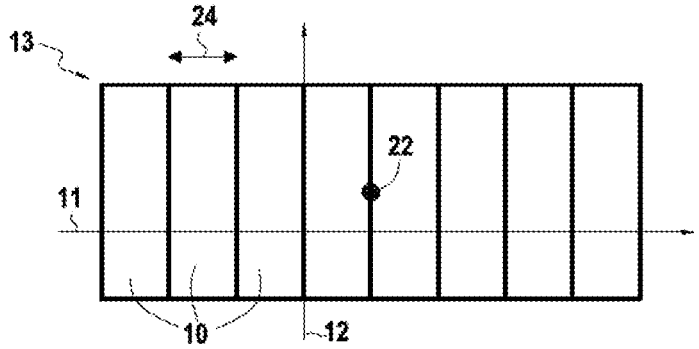
Figure 7:
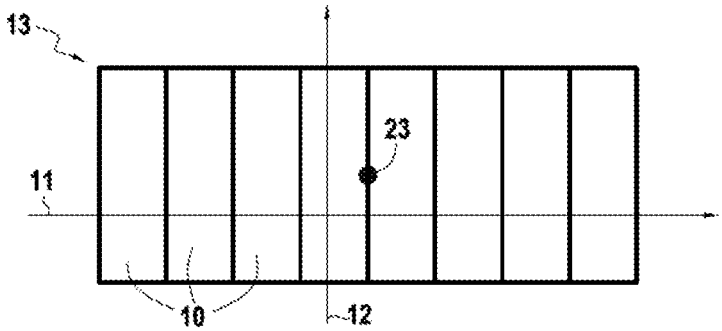
Figure 8:
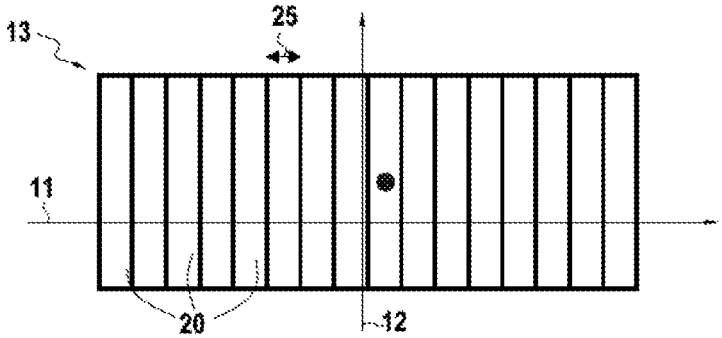
Figure 9:
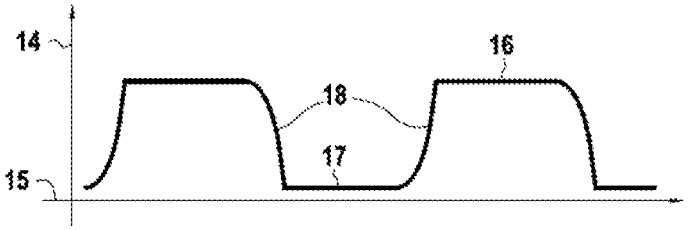
Figure 10:
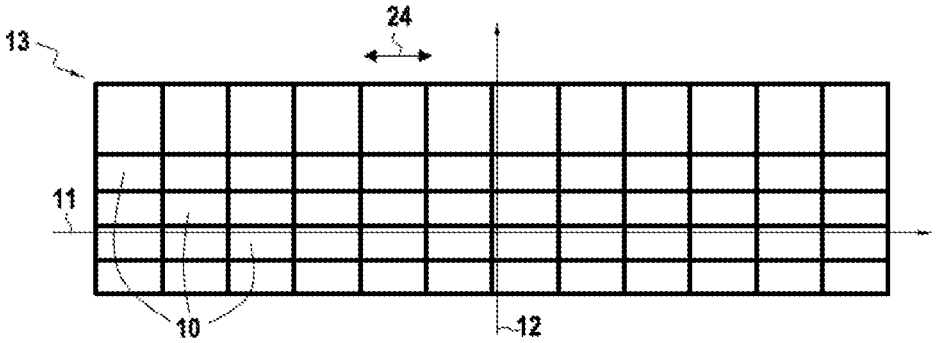
Figure 11:
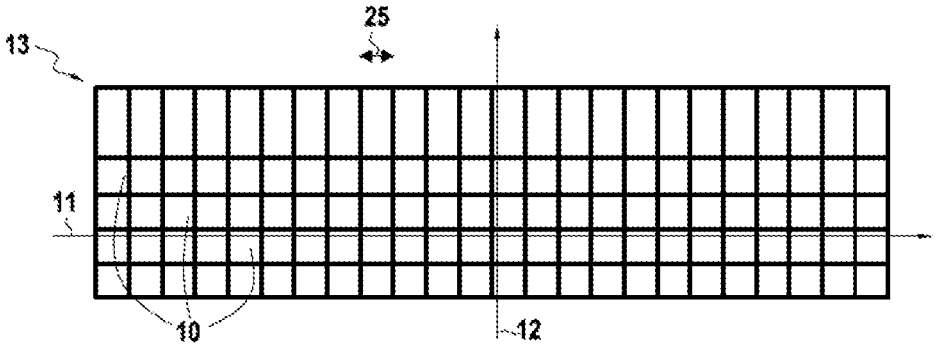
Figure 12:
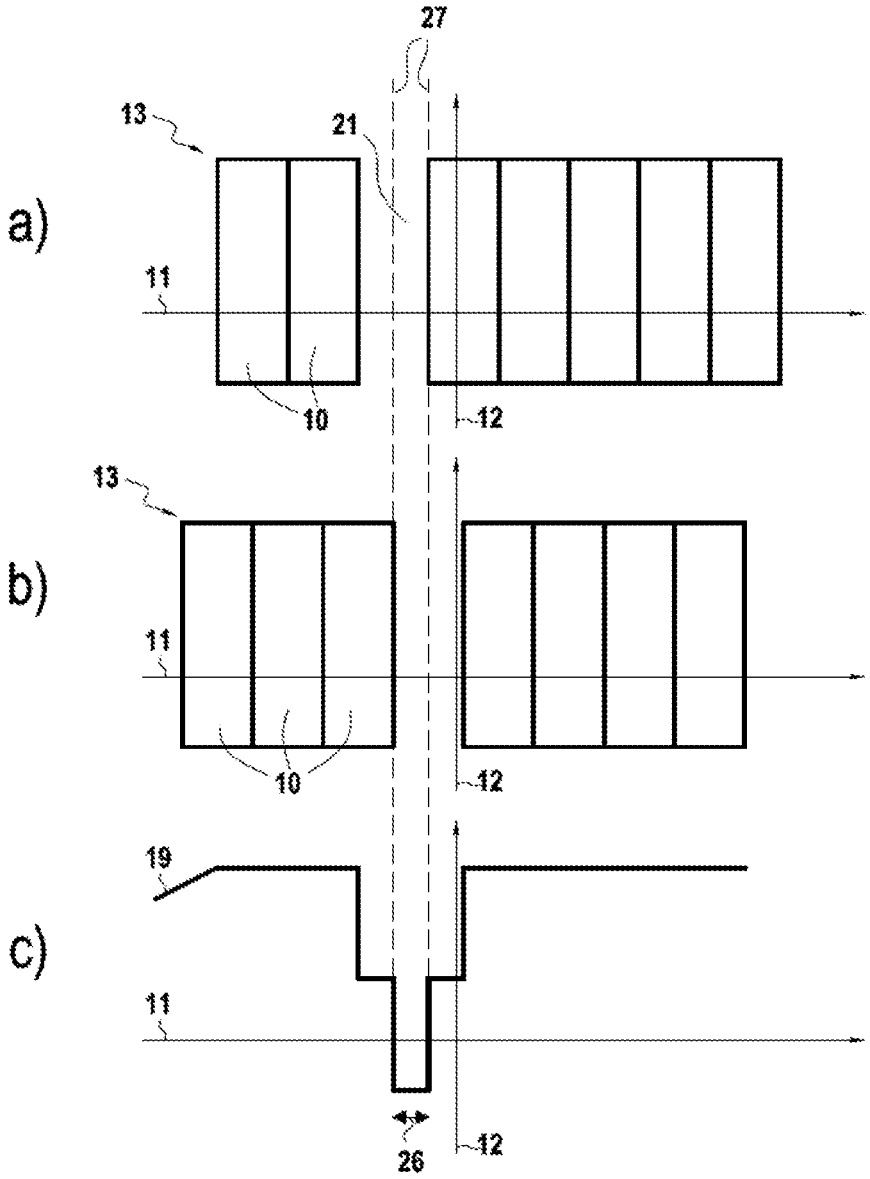

The invention will be better understood in the light of the following description which is given only by way of indication, which is not intended to limit it and is given with reference to the appended drawings:

FIG. 1 diagrammatically showing a perspective view of a first embodiment of a device according to the invention, FIG. 2 diagrammatically showing a plan view of a second embodiment of a device according to the invention, FIG. 3 diagrammatically showing a plan view of a third embodiment of a device according to the invention, FIG. 4 diagrammatically showing a plan view of a fourth embodiment of a device according to the invention, FIG. 5 diagrammatically showing a plan view of a fifth embodiment of a device according to the invention, FIG. 6 diagrammatically showing a light beam projected by the device with an optical axis in a first direction, FIG. 7 diagrammatically showing a light beam projected by the device with an optical axis in a second direction, FIG. 8 diagrammatically showing a light beam perceived by an observer, FIG. 9 diagrammatically showing a graph representing the displacement of the optical axis of the light beam, FIG. 10 diagrammatically showing another type of light beam projected by the device, FIG. 11 diagrammatically showing the light beam perceived by the observer on the basis of the one shown in FIG. 10, FIG. 12 diagrammatically showing the formation of a shadow zone in a beam.

FIGS. 1 to 5 show five different embodiments of the device 1 for projecting of a light beam and having a mechanical actuator according to the invention. The projection device 1 can notably be part of an optical module of a motor vehicle headlamp, which is provided with projection lens forming means which partly form the output light beam of the optical module. The lens forming means are represented by a single projection lens 3 in the figures.

In FIG. 1, the device 1 comprises an array of light sources capable of emitting light rays in order to form the light beam and an optical system configured for partly forming the beam from the light rays coming from the light sources. The array is for example a matrix of light emitting diodes and the optical system is a simple lens or a correction lens or a system of several lenses which serves to homogenize the light beam and/or to correct the optical aberrations. The array of light sources and the optical system are together represented by a single element and are called a source assembly 2 in the description. Each light source of the array provides a component of the light beam projected by the device 1.

The light beam emitted by the device emerges through the projection lens 3 along an optical axis 4. The light beam 13, shown diagrammatically in the FIG. 6, is horizontally divided into several components 10, vertically extended in this case, each light source of the array defining a component 10 of the beam 13. Each rectangle therefore corresponds to a component 10 of the beam 13 emitted by a different source. In this case, the array is a series of aligned light sources, for example a bar of light emitting diodes. The optical axis of the beam 13 is represented by a central spot 22, the vertical and horizontal arrows illustrating the axes 11, 12 of a reference system fixed in space. The beam 13 has moreover an angle of resolution defined in the horizontal plane, the horizontal plane being defined by the horizontal axis 11 and the angle of resolution by the double headed arrow 24. In the description, the angle of resolution of the beam 13 is taken, by way of example, to be equal to 1°.

In order to increase the optical resolution of the beam 13, and therefore to reduce the angle of resolution, the device 1 is configured for periodically shifting the optical axis of the light beam 13 between two directions of projection.

For this purpose, in the first embodiment shown in FIG. 1, the device 1 is provided with a mechanical actuator 5 capable of displacing the source assembly 2 in translation with respect to the projection lens 3. The mechanical actuator 5 is a two-position mechanical actuator, for example an electromagnet, a motor provided with a cam, a stepper motor or a piezoelectric motor.

The source assembly 2 is driven with a displacement in a plane substantially parallel with the projection lens 3. The source assembly 2 moves between two extreme positions, the first position corresponding to a first direction of projection of the optical axis of the beam and the second position corresponding to a second direction of projection of the optical axis.

FIG. 6 shows the beam 13 and its optical axis (spot 22) in the first direction and FIG. 7 shows the beam and its optical axis (spot 23) in the second direction. It is noted that, as the reference system of the vertical 12 and horizontal 11 axes is fixed, the beam is offset towards the left. The horizontal difference in position of the spots 22 and 23 with respect to the fixed horizontal reference 11 corresponds to half of the angle of resolution represented by the double headed arrow 24.

For a beam provided with vertical components 10, such as the one shown in FIG. 6, the source assembly 2 is offset horizontally so that the axis of the beam moves along the horizontal axis 11. The displacement of the beam is therefore carried out substantially in the plane of division into components 10 of the beam 13. If the beam 13 were vertical with horizontal components 10, the source assembly 2 would be moved vertically. Thus the two directions of the optical axis of the beam 13 form between them an angle of displacement substantially coplanar with the angle of resolution of the beam.

The two extreme positions are chosen such that the angle of displacement of the optical axis of the beam 13 is equal to a fraction of the angle of resolution of the beam 13. In order to reduce the angle of resolution, for example by half, the angle of displacement between the two positions is preferably substantially equal to half of the angle of resolution, that is to say 0.5° in this case. In FIGS. 6 and 7 it can be seen that the vertical axis 12 is moved, from the boundary between the third and fourth components in FIG. 6, towards the center of the fourth component in FIG. 7.

The source assembly 2, and therefore the axis of the beam 13, is moreover moved between the two positions by the actuator 5, at a specified displacement frequency which is not perceptible by the human eye. Such a frequency must be higher than 40 Hz, and is preferably between 100 Hz and 200 Hz.

Thus, an observer looking at the projected beam 13 is not able to discern the two directions of the beam 13. In other words, the observer sees a superimposition of the two directions of the same beam 13, that is to say of the beam 13 shown in FIG. 6 when the optical axis is in the first direction, and of the beam shown in FIG. 7 when the optical axis 13 is in the second direction.

FIG. 8 shows us the effect obtained by this superimposition, and the beam 13 which is actually perceived by an observer. It is noted that the beam 13 then has an angle of resolution 25, represented by the two-headed arrow, which is two times smaller than that of the original beam, that is to say 0.5°. The resolution of the beam has thus been multiplied by two.

The mechanical actuator 5 is moreover configured for displacing the source assembly 2, and therefore the optical axis of the light beam 13, in a discontinuous manner, such that the optical axis of the light beam 13 is held in each of the two directions for a holding time which is longer than the transition time between the two directions of projection. In other words, the displacement does not follow a movement at constant speed.

In fact, a superimposition of the two orientations of the beam is desired whilst minimizing the superimposition of other directions of the beam which correspond to intermediate positions. As shown in FIG. 9, where the vertical axis 14 represents the position of the source assembly 2 and the horizontal axis 15 represents time, the displacement follows a substantially rectangular periodic function. The top 16 and bottom 17 levels of the rectangular waveform correspond to the holding time in each of the two extreme positions and the slopes 18 joining each top level 16 to a bottom level 17 correspond to the transition time. In this case, it is noted that the holding time lasts about four times longer than the transition time. Advantageously, the holding time is at least four times longer than the transition time, preferably at least twenty times and more preferably at least fifty times.

In a variant embodiment, FIG. 10 shows a beam 13 comprising vertical and horizontal components, the source array being for example a matrix of light emitting diodes. FIG. 11 shows the beam 13 perceived by an observer when the beam 13 is in motion by means of the device 1 according to the invention. The beam 13 is moved horizontally, in a way similar to the example shown in FIGS. 6 and 7, and makes it possible to obtain increased horizontal resolution.

As shown in FIG. 12, the light sources can be activated individually in order to be able to switch off certain components 10 of the beam whilst the other components remain switched on. The projected beam can thus be modulated in order to produce a mobile shadow zone 21 in the light beam 13. When a single light source is inactive, a shadow zone appears in the beam 13, the resolution angle of which is equal to 1° in the preceding example, the beam 13 being fixed. FIGS. 12(*a*) and 12(*b*) show an example of a light beam with a shadow zone produced by the third component switched off in FIG. 12(*a*) and the fourth component switched off in FIG. 12(*b*).

When the same light source is left inactive whilst the beam changes direction periodically according to the invention, the angle of resolution of the shadow zone is reduced to 0.5°. However, in this case, the shadow zones 21 can only appear on certain components with an angle of resolution of 0.5°, an additional component always being switched on. More precisely, only one out of two components of the beam with an angle of resolution of 0.5° can appear switched off.

According to a first variant embodiment, in order to make shadow zones appear on the other components with an angle of resolution of 0.5°, the light sources are activated at an activation frequency which is synchronized with the frequency of displacement of the mechanical actuator 5. This synchronization is shown in FIG. 12. FIG. 12(*a*) shows the light beam 13 oriented in a first direction and FIG. 12(*b*) shows the same light beam 13 oriented in the second direction. In FIG. 12(*a*), the light source defining the third component is inactive and, in FIG. 12(*b*), it is the light source defining the fourth component which is inactive. Thus the activated light source is alternated simultaneously with the change of direction of the beam 13 in order to obtain the shadow zone in the desired component. The switched off component is thus shifted in the reverse direction to that of the displacement of the beam 13. Preferably, the activation frequency is substantially equal to the frequency of displacement of the beam.

FIG. 12(*c*) is a graph representing the light intensity 19 of the beam 13 having a single shadow zone corresponding to a single component having an angle of resolution 26 of 0.5°. The superimposition of the two beams 13 of FIGS. 12(*a*) and 12(*b*) results in a component having an angle of resolution of 0.5° which is completely switched off because it results from a superimposition of two shadow zones, as shown by the dotted lines 27 in FIGS. 12(*a*), 12(*b*) and 12(*c*). This component 21 is surrounded on either side by two components whose light intensity value is half as great as the normal light intensity of a component, because they are obtained by the superimposition of a shadow zone and a switched on zone. The other components all have normal light intensities because they are obtained by the superimposition of two switched on zones.

According to another variant embodiment, which is not shown in the figures, the mechanical actuator 5 is configured for periodically displacing the source assembly 2 between an intermediate position and another position to be chosen from two opposite extreme positions with respect to the intermediate position. The periodic displacement between the intermediate position and the first extreme position makes it possible to cause the appearance of a shadow zone having an angle of resolution of 0.5° on the beam with one inactive light source. The periodic displacement between the intermediate position and the second extreme position makes it possible to cause the appearance of an additional shadow zone having an angle of resolution of 0.5° on the beam with the same inactive light source. Consequently, the axis of the beam is periodically oriented between an intermediate direction and a second direction chosen from two extreme directions corresponding to the displacement of the source element 2.

Thus, depending on the component to be switched off, the mechanical actuator moves the source assembly either between the intermediate position and the first extreme position or between the intermediate position and the second extreme position. Each displacement produces an effect similar to the one shown in FIGS. 6 and 7 regarding the reduction of the angle of resolution. In this variant, the synchronization of the activation of the light sources with the displacement of the beam is not necessary, because it is possible to cause the appearance of shadow zones over the whole of the beam.

The following embodiments have the same effects and advantages on the light beam as the first embodiment.

FIG. 2 is shows a second embodiment similar to the first one, with the same elements having the same references. The difference is due to the mechanical actuator 5 which in this case moves the source assembly 2 in rotation. In order to change from one position to the other, the source assembly 2 follows a curve 6 corresponding to the focal curve of the projection lens 3, the focal point 7 on the image side of which is shown. This embodiment is advantageous, notably with regard to the field curvature, when the optical system of the source assembly 2 is simple, with a single lens for example. On the other hand, the first embodiment is advantageous for more complex optical systems.

In a third embodiment, shown in FIG. 3, the mechanical actuator 5 moves only the projection lens 3 in translation. In this case, the source assembly 2 is fixed and it is the displacement of the projection lens 3 which defines the orientation of the axis 4 of the beam.

According to a fourth embodiment, shown in FIG. 4, the mechanical actuator 5 moves in rotation all of the other elements of the device 1, that is to say that the source system 2 and the projection lens 3 are jointly moved around a common axis. This embodiment corresponds to the horizontal or vertical displacement of an optical module in rotation about an axis.

In a fifth embodiment, shown in FIG. 5, the device 1 comprises a mirror 9 configured for reflecting the light beam coming from the source assembly 2 towards the projection lens 3. In this case, the mechanical actuator 5 moves the mirror 9, either in translation when the mirror 9 is the only element to be moved, or in rotation when it is moved jointly with the source assembly 2.

The description describes examples of the invention having an angle of resolution divided by two. However, the device could be adapted in such a way as to further divide the angle of resolution of the beam. Thus, by choosing to periodically orient the beam in three directions instead of two, it is possible to divide the angle of resolution by three and achieve an angle substantially equal to 0.33° for the abovementioned examples. For this purpose, the actuator 5 is configured for periodically displacing at least one of the elements of the device 1 over three positions. The frequency of the displacement of the beam is therefore chosen such that the displacement is not perceptible by an observer. In the example having three directions, the frequency is at least 60 Hz.

The invention claimed is:

1. A device for projecting a light beam and having a mechanical actuator for a motor vehicle, the device comprising:

an array of light sources able to emit light rays in order to form the light beam along an optical axis, each light source defining a component of the light beam which has an angle of resolution defined in a plane;

a mechanical actuator configured to displace at least one element of the device in such a way that the optical axis of the light beam is moved between at least two projection directions according to a displacement oscillating periodically at a specified frequency of displacement, the projection directions forming between them an angle of displacement substantially coplanar with the angle of resolution, the angle of displacement being equal to a fraction of the angle of resolution of the light beam.

2. The device according to claim 1, wherein the angle of displacement is substantially equal to half of the angle of resolution.

3. The device according to claim 2, wherein the mechanical actuator is configured to move the element in such a way that the frequency of displacement of the optical axis is a frequency that is not perceptible by the human eye.

4. The device according to claim 2, wherein the mechanical actuator is configured to displace the element in a discontinuous manner in such a way that the optical axis of the light beam is held in each direction of projection for a holding time that is longer than the time of transition between the two directions of projection.

5. The device according to claim 2, wherein the light sources are configured to be activated individually at a specified activation frequency in order to modulate the projected beam in such a way as to produce a mobile shadow zone in the light beam.

6. The device according to claim 2, further comprising:

an optical system configured to partly form the light beam from the light rays coming from the light sources.

7. The device according to claim 1, wherein the mechanical actuator is configured to move the at least one element in such a way that the frequency of displacement of the optical axis is a frequency that is not perceptible by the human eye.

8. The device according to claim 1, wherein the mechanical actuator is configured to displace the at least one element in a discontinuous manner in such a way that the optical axis of the light beam is held in each direction of projection for a holding time that is longer than the time of transition between the two directions of projection.

9. The device according to claim 1, wherein the light sources are configured to be activated individually at a specified activation frequency in order to modulate the projected beam in such a way as to produce a mobile shadow zone in the light beam.

10. The device according to claim 9, wherein the activation frequency of the light sources and the displacement frequency of the optical axis are synchronized.

11. The device according to claim 1, further comprising:

an optical system configured to partly form the light beam from the light rays emitted from the light sources.

12. The device according to claim 1, wherein the array of light sources is a matrix of light emitting diodes.

13. The device according to claim 1, further comprising:

projection lens forming means configured to partly form the light beam.

14. The device according to claim 13, wherein the mechanical actuator is configured to move the projection lens forming means and the array of light sources jointly in rotation.

15. The device according to claim 13, wherein the mechanical actuator is configured to move the projection lens forming means in translation.

16. The device according to claim 1, wherein the mechanical actuator is configured to displace the array of light sources in translation.

17. The device according to claim 1, wherein the mechanical actuator is configured to move the array of light sources in rotation.

18. The device according to claim 1, further comprising:

a mirror configured to reflect the light beam, wherein the mechanical actuator is configured to move the mirror.

19. An optical module comprising a device for projecting a light beam and having a mechanical actuator according to claim 1.

20. A motor vehicle headlamp comprising an optical module according to claim 19.

* * * * *